US007685772B2

(12) United States Patent
Ohata

(10) Patent No.: US 7,685,772 B2
(45) Date of Patent: Mar. 30, 2010

(54) PLATFORM DOOR DEVICE

(75) Inventor: Mitsuyasu Ohata, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 631 days.

(21) Appl. No.: 11/230,519

(22) Filed: Sep. 21, 2005

(65) Prior Publication Data

US 2006/0107596 A1 May 25, 2006

(30) Foreign Application Priority Data

Nov. 17, 2004 (JP) ..... 2004-332611

(51) Int. Cl.
*E05F 15/14* (2006.01)

(52) U.S. Cl. ..... 49/362; 49/425

(58) Field of Classification Search ..... 49/323, 49/360, 362, 404, 120, 125, 370, 380, 409, 49/410, 425

See application file for complete search history.

(56) References Cited

U.S. PATENT DOCUMENTS

| | | | | |
|---|---|---|---|---|
| 2,346,388 | A * | 4/1944 | Peebles | 49/360 |
| 4,366,649 | A * | 1/1983 | Weigant | 49/362 |
| 5,136,813 | A * | 8/1992 | Gibbs et al. | 49/404 |
| 5,148,630 | A * | 9/1992 | Llorens | 49/425 |

FOREIGN PATENT DOCUMENTS

| | | |
|---|---|---|
| EP | 0134824 | 3/1985 |
| FR | 2575984 | 7/1986 |
| GB | 2204082 | 11/1988 |
| JP | 11-334579 A | 12/1999 |
| JP | 2002-308089 | 10/2002 |
| JP | 2003-328656 A | 11/2003 |
| JP | 2004-131008 | 4/2004 |
| JP | 2004114824 | 4/2004 |

OTHER PUBLICATIONS

Office Action for JP2004-332611 dated May 8, 2009.

* cited by examiner

*Primary Examiner*—Katherine W Mitchell
*Assistant Examiner*—Michael J Keller
(74) *Attorney, Agent, or Firm*—Lowe Hauptman Ham & Berner, LLP

(57) ABSTRACT

The present invention provides a platform door device in which two movable fences 33, which are provided along the side edge 30*a* of a station platform 30 for getting on and off a car and each supported movably by a support member 32, move relative to each other in the longitudinal direction of the platform 30 to open and close a passage between the platform side and the car side, wherein the platform door device is configured so that the two support members 32 are erected on the platform 30 and are housed in the two movable fences 33; the two support members 32 are housed in the two movable fences 33; and each of the support members 32 is arranged in a plane in the thickness direction of each of the movable fences 33 so as to be covered with the movable fence 33, by which the movable fence 33 can be moved relatively between the inner surface thereof and the outer surface of the support member 32.

3 Claims, 9 Drawing Sheets

PLATFORM DOOR DEVICE

RELATED APPLICATIONS

The present application is based on, and claims priority from, Japanese Application Serial Number 2004-332611, filed Nov. 17, 2004, the disclosure of which is hereby incorporated by reference herein in its entirety.

BACKGROUND OF THE INVENTION AND RELATED ART STATEMENT

1. Field of the Invention

The present invention relates to a platform door device applied to a station platform etc. More particularly, it relates to a platform door device in which two movable fences, which are provided along the side edge of a station platform for railroad cars and each supported movably by a support member, move relative to each other in the car running direction on the platform to open and close a passage between the platform side and the car side.

2. Description of Related Art

Among station platforms for railroad cars, the number of platforms each equipped with a platform door device provided with a movable fence has increased to prevent accidents such as passengers falling onto the railway tracks, or passengers coming into contact with a car. Such a platform door device is usually constructed so that two movable fences provided along the side edge of the platform are supported movably by support members, and the two movable fences move relative to each other in the car running direction to open and close a passage between the platform side and the car side.

FIGS. 7 to 9 show a platform door device disclosed in Patent Document 1 (Japanese Patent Provisional Publication No. 2004-131008). FIG. 7 is a general perspective view, FIG. 8 is a side view of a principal portion, showing one side of a movable fence, and FIG. 9 is a sectional view taken along the line X-X of FIG. 8.

In FIGS. 7 to 9, reference numeral 1 denotes a platform door, in which two movable fences 5 are supported so as to be slidable in the direction indicated by arrows in FIG. 7 in such a manner as to overlap with each other in the longitudinal direction (the direction perpendicular to a side edge 3 of a platform 2, namely, the direction perpendicular to the car running direction) of a fence member 4 erected at the side edge 3 of the platform 2. The movable fence 5 goes in and out through a gateway 7 formed in each side surface portion 6 of the fence member 4.

As shown in FIG. 8, the movable fence 5 is rotatably provided with two guide roller members 10 on the upper and lower sides, and two guide rails 11 are fixed to the upper and lower sides of the fence member 4. By the rolling motion of the roller members 10 along the guide rails 11, the two movable fences 5 can be moved smoothly in a reciprocating manner with respect to the fence member 4.

Also, the fence member 4 is provided with drive motors 12, and a pinion 13 is provided on the output shaft of each of the drive motors 12. On the other hand, in a central portion in the height direction of the movable fence 5, a rack 14 engaging with the pinion 13 is provided in parallel with the guide rails 11. Therefore, when the drive motor 12 is rotated, the movable fence 5 is moved in a reciprocating manner as indicated by an arrow in FIG. 7 by the engagement of the pinion 13 with the rack 14.

Also, as shown in FIG. 9, within the fence member 4, two support plates 20 and 21 erected on the platform 3 are arranged. On the side surfaces of the support plates 20 and 21, the drive motor 12 is installed.

Further, the fence member 4 is provided with a cover 22, one end portion of which is fixed at the upper end of the support plate 21. The whole of the support plates 20 and 21 and the movable fences 5 that go into and out of the fence member 4 is covered with the cover 22 so that a relatively moving portion between the support plates 20 and 21 and the movable fences 5 is not exposed to the outside, and dust etc. is prevented from entering into the relatively moving portion from the outside. The gateways 7 are open in side surface portions 6 of the cover 22 so that the movable fences 5 go in and out through the gateways 7.

The above-described conventional platform door device has problems as described below.

In the above-described related art, the platform door device has a construction such that the fence member 4 is erected along the side edge 3 of the platform 2; the movable fences 5 are arranged in parallel with each other in the side portions of the two support plates 20 and 21; the roller members 10, the drive motors 12, and the like are arranged between the support plates 20 and 21 and the movable fences 5; and further the elements within the fence member 4 are covered with the cover 22. Therefore, the thickness of the fence member 4, namely, a width W0 (refer to FIG. 9) in the direction perpendicular to the side edge 3 of the platform 2 increases undesirably.

Thereupon, in the above-described related art, the increase in the thickness W0 of the fence member 4 obstructs the space along the side edge 3 of the platform 2, and hence hinders passengers and other people from passing. Also, on a platform 2 with a narrow width, the platform door device having the above-described construction cannot be adopted.

OBJECT AND SUMMARY OF THE INVENTION

The present invention has been made to solve the problems with the related art, and accordingly an object thereof is to provide a platform door device in which two movable fences supported by support members provided along a side edge of a platform so as to be movable relative to the support members are provided so that the width thereof in the direction perpendicular to the side edge of platform is narrow, by which the space along the side edge of platform is increased to enable the space for people to pass through to be increased, and also the platform door device can easily be applied to a platform with a narrow width.

To achieve the above object, the present invention provides a platform door device in which two movable fences, which are provided along the side edge of a station platform for getting on and off a car and each supported movably by a support member, move relative to each other in the longitudinal direction of the platform to open and close a passage between the platform side and the car side, wherein the platform door device is configured so that the two support members are erected on the platform and are housed in the two movable fences; and each of the support members is arranged in a plane in the thickness direction of each of the movable fences so as to be covered with the movable fence, by which the movable fence can be moved relatively between the inner surface thereof and the outer surface of the support member.

In the present invention, preferably, a guide rail extending in the travel direction of the movable fence is provided on the upper inner surface of each of the two movable fences; a slide block is installed in the upper end portion of each of the two support members; and the slide block is moved along the guide rail, by which the movable fence is moved relative to the support member.

Also, in the present invention, a driving system for relatively moving the two movable fences is housed in a driving system housing hole formed in the platform, and the output end of the driving system is connected to the lower end portion of the movable fence via a driving force transmitting system.

Further, in the present invention, the driving force transmitting system is configured so that a rack, which is provided in the lower end portion of each of the two movable fences, and a pinion, which is rotatably supported on a rotating shaft and engages with the rack, are provided; the driving system is disposed under the pinion; and the power of the driving system is transmitted to the pinion and the rack via a sprocket connected to the output end of the driving system and a chain, by which the two movable fences are moved relatively.

Also, in the present invention, the driving system for relatively moving the two movable fences is arranged in one side position of either of the movable fences, and the output end of the driving system is connected to the lower end portion of the movable fence via the driving force transmitting system.

Further, in the present invention, the driving force transmitting system is configured so that a rack provided in the lower end portion of each of the two movable fences and a pinion engaging with the rack are provided; the output end of the driving system is directly connected to the rotating shaft rotatably supporting the pinion; and the power of the driving system is transmitted to the pinion and rack via the rotating shaft, by which the two movable fences are moved relatively.

Still further, in the present invention, a guide rail extending in the travel direction of the movable fence is provided on the upper inner surface of each of the two movable fences; a slide block is installed in the upper end portion of each of the two support members; and the slide block is moved along the guide rail, by which the movable fence is moved relative to the support member.

According to the present invention, since each of the support members is arranged in a plane in the thickness direction of each of the movable fences so as to be covered with the movable fence, the width in the direction perpendicular to the side edge of the platform can be reduced significantly as compared with the configuration of the related art, in which two support plates and two movable fences are arranged parallel to each other in the direction perpendicular to the side edge of the platform, the two support plates and the two movable fences are covered with a cover, and further the drive motor is disposed between the movable fence and the support member. Therefore, this platform door device can avoid obstruction of the space along the side edge of the platform and hence hindrance to passing of passengers and other people, and also can provide some extra space to the platform.

Also, since the width in the direction perpendicular to the side edge of the platform can be reduced significantly as described above, the platform door device in accordance with the present invention can easily adopted even on a platform with a narrow width. Moreover, according to the present invention, since each of the two support members is arranged in a plane in the thickness direction of each of the movable fences so as to be covered with the movable fence, a relatively moving portion between the support member and the movable fence is not exposed to the outside, and a covering function is provided to prevent dust etc. from entering into the relatively moving portion from the outside. Therefore, unlike the related art, a cover for covering the two support members and two movable fences need not be provided separately. Thereby, the number of parts can be reduced, and the construction can be simplified.

According to the present invention, since the driving system for relatively moving the two movable fences is housed in the driving system housing hole formed in the platform, unlike the related art, the drive motor need not be arranged between the movable fence and the support member. Therefore, the width in the direction perpendicular to the side edge of the platform can be reduced significantly as compared with the related art, so that the effective utilization of the platform can be improved.

Also, according to the present invention, the configuration is such that the pinion and the rack are driven by the driving force transmitting system in which the driving system is arranged under the pinion which engages with the rack provided in the lower end portion of the movable fence to move in a reciprocating manner the movable fence via the rack, and the driving system, the sprocket, and the chain are arranged in the height direction. Therefore, the attachment width of the driving system and the driving force transmitting system does not increase in the direction perpendicular to the side edge of the platform, and the driving system and the driving force transmitting system can be arranged in the plane in the thickness direction of the movable fence. From this aspect as well, the effective utilization of the platform can be improved.

Further, according to the present invention, even in a case where it is impossible to form the driving system housing hole in the platform, the driving system is disposed in one side position of either of the movable fences. Therefore, unlike the related art, the drive motor need not be arranged between the movable fence and the support member, so that the width in the direction perpendicular to the side edge of the platform can be reduced significantly as compared with the related art, by which the effective utilization of the platform is improved. Moreover, since the pinion is attached to the rotating shaft directly connected to the driving system, a special driving force transmitting system including sprockets and a chain is not needed, so that the construction is simple, and the number of parts can be reduced.

DETAILED DESCRIPTION OF PREFERRED EMBODIMENTS

First Embodiment

The present invention will now be described in detail with reference to an embodiment shown in the accompanying drawings.

Figure 1:
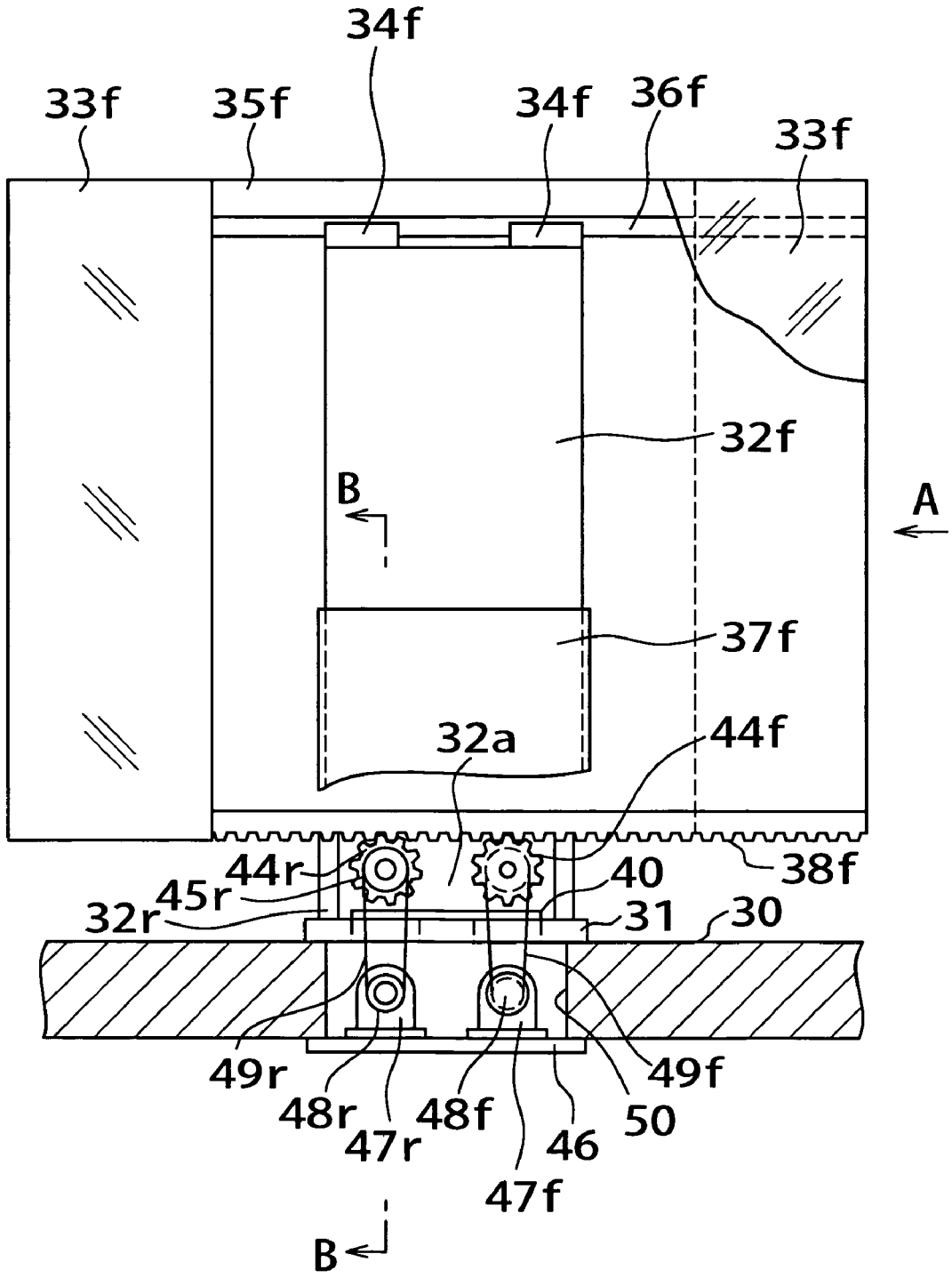
FIG. 1 is a front view, including a partial cross section, of a platform door device in accordance with a first embodiment of the present invention.
Figure 2:
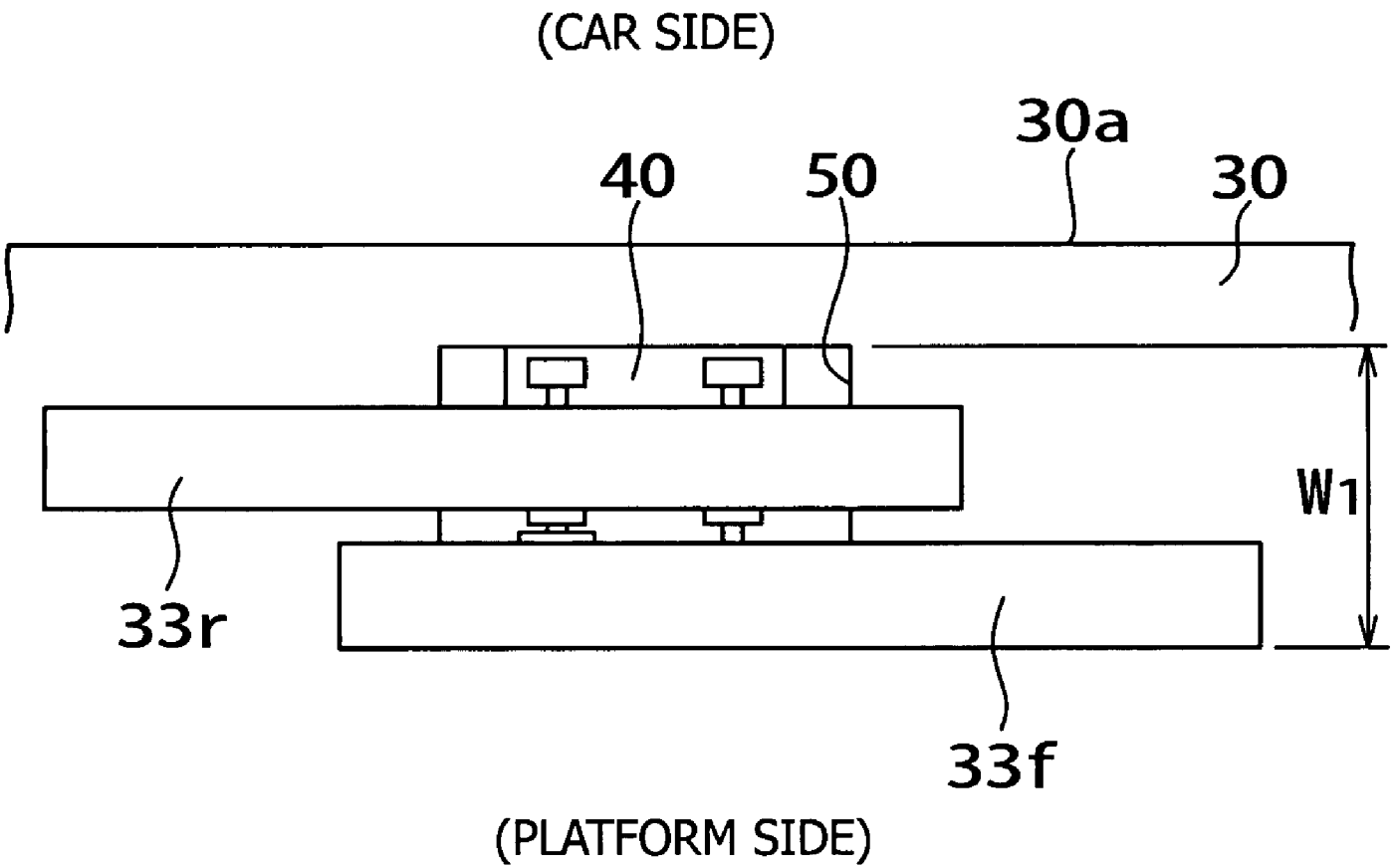
FIG. 2 is a plan view of a principal portion of a platform door device in accordance with the first embodiment.
Figure 3:
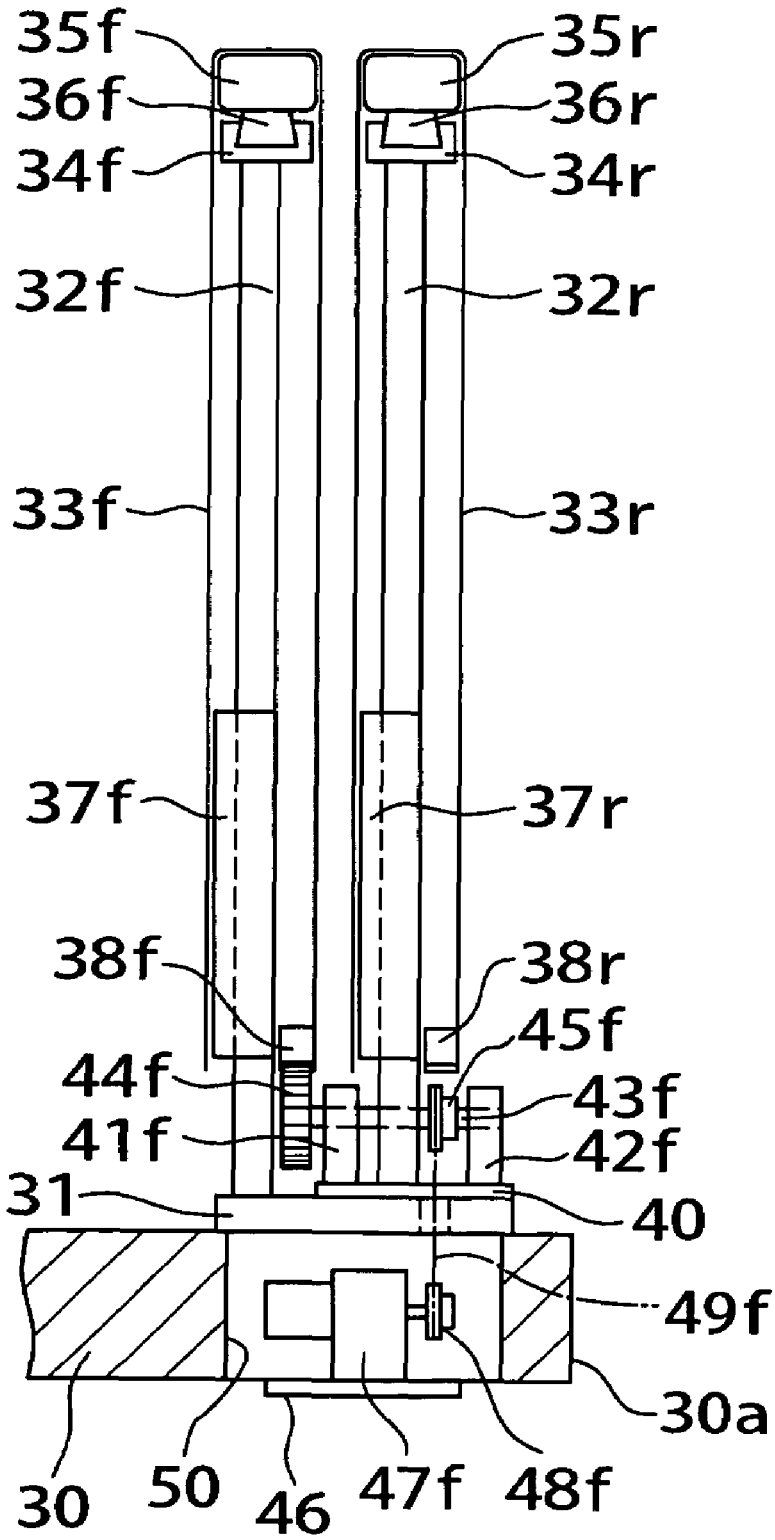
FIG. 3 is a view taken in the direction of the arrow A of FIG. 1.
Figure 4:
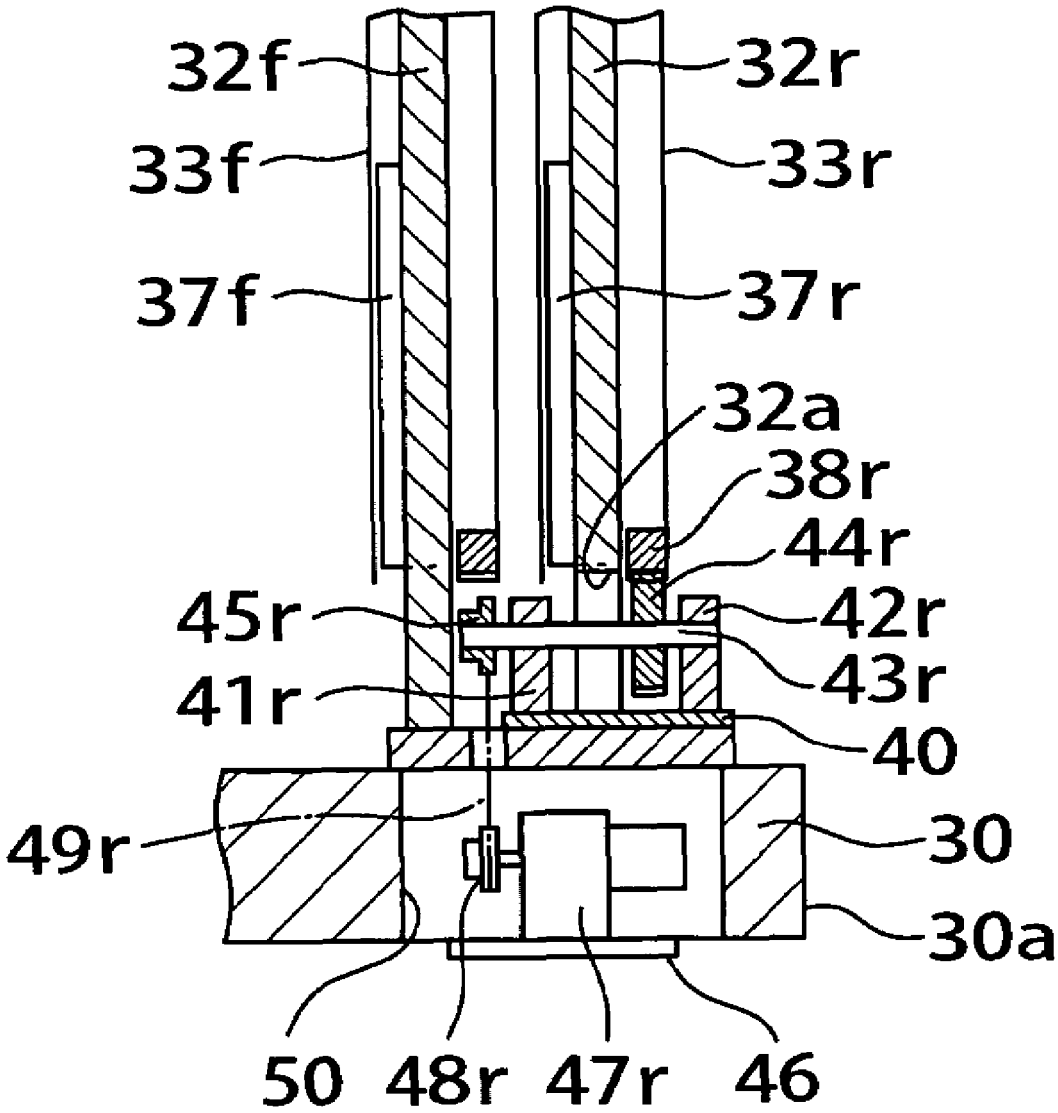
FIG. 4 is a sectional view taken along the line B-B of FIG. 1.

FIG. 1 is a front view, including a partial cross section, of a platform door device in accordance with a first embodiment of the present invention, FIG. 2 is a plan view of a principal portion of the platform door device, FIG. 3 is a view taken in the direction of the arrow A of FIG. 1, and FIG. 4 is a sectional view taken along the line B-B of FIG. 1.

In the description below, the platform side (front side) is represented by the suffix f, and the car side (rear side) is represented by the suffix r.

In FIGS. 1 to 4, reference character 30 denotes a platform, and 30*a* denotes a side edge of the platform 30. Two flat plate shaped support members 32*f* and 32*r* are erected and fixed by welding etc. on the top surface of a bed plate 31 installed on the platform 30.

Reference characters 33*f* and 33*r* denote movable fences. The movable fences 33*f* and 33*r* are configured so as to cover the two support members 32*f* and 32*r*, respectively, from the outside over the total height to contain the support members 32*f* and 32*r* within the movable fences 33*f* and 33*r*, respectively, so that each of the support members 32*f* and 32*r* is contained in a plane in the thickness direction of each of the movable fences 33*f* and 33*r*.

On the upper end surface of the support member 32*f*, 32*r*, two (or more) slide blocks 34*f*, 34*r* such as linear ways are installed in the longitudinal direction (hereinafter, the car running direction, namely, the direction along the side edge 30*a* of the platform 30 is called the longitudinal direction).

Reference characters 35*f* and 35*r* denote beams fixed on the upper inner surfaces of the movable fences 33*f* and 33*r*, respectively. The beam 35*f*, 35*r* extends in the travel direction of the movable fence 33*f*, 33*r*. Reference characters 36*f* and 36*r* denote guide rails which are fixed on the lower surfaces of the beams 35*f* and 35*r* and extend in the travel directions of the movable fence 33*f* and 33*r*, respectively. By moving the slide block 34*f*, 34*r* along the guide rail 36*f*, 36*r*, the movable fence 33*f*, 33*r* can be moved relative to the support member 32*f*, 32*r*.

Reference characters 37*f* and 37*r* denote guide plates installed on the lower side surfaces of the support members 32*f* and 32*r*, respectively. The guide plate 37*f*, 37*r* guides the lower part of the movable fence 33*f*, 33*r* to the support member 32*f*, 32*r*.

The lower end portion of the movable fence 33*f*, 33*r* is formed with a rack 38*f*, 38*r*, and the rack 38*f*, 38*r* engages with a pinion 44*f*, 44*r*. Also, the lower end portion of one support member 32*r* is formed with a hole 32*a*, and an attachment plate 40 is fixed on the bed plate 31 in a form such as to pass through the hole 32*a*.

On the attachment plate 40, bearings 41*f* and 42*f* on the platform side (front side) and bearings 41*r* and 42*r* on the car side (rear side) are installed. The bearings 41*f* and 42*f* rotatably support a rotating shaft 43*f*, and the bearings 41*r* and 42*r* rotatably support a rotating shaft 43*r*.

The shaft end portion of the rotating shaft 43*f* on the platform side (front side) is fitted with the pinion 44*f*, and an intermediate portion of the rotating shaft 43*r* on the car side (rear side) is fitted with the pinion 44*r*. As described above, the pinion 44*f* engages with the rack 38*f*, and the pinion 44*r* engages with the rack 38*r*.

Also, an intermediate portion of the rotating shaft 43*f* is fitted with a sprocket 45*f*, and the shaft end portion of the rotating shaft 43*r* is fitted with a sprocket 45*r*.

Reference character 46 denotes a lower attachment plate fixed on the lower surface of the platform 30. The upper surface of the lower attachment plate 46 faces to a driving system housing hole 50 formed in the platform 30. On the upper surface of the lower attachment plate 46, a drive motor 47*f* on the platform side (front side) and a drive motor 47*r* on the car side (rear side) are mounted so as to be contained in the driving system housing hole 50. On the output shaft of the drive motor 47*f*, a sprocket 48*f* is installed, and on the output shaft of the drive motor 47*r*, a sprocket 48*r* is installed.

As shown in FIG. 1, the drive motor 47*f* on the platform side and the drive motor 47*r* on the car side are arranged side by side in the longitudinal direction of the platform 30. The sprocket 48*f* of the drive motor 47*f* on the platform side is connected to the sprocket 45*f* on the rotating shaft 43*f* side via a chain 49*f*, and the sprocket 48*r* of the drive motor 47*r* on the car side is connected to the sprocket 45*r* on the rotating shaft 43*r* side via a chain 49*r*.

By the above-described construction, the movable fence 33*f* on the platform side is moved reciprocatingly in the longitudinal direction of the platform 30 by the driving motor 47*f* via the sprocket 48*f*, the chain 49*f*, the sprocket 45*f* on the rotating shaft 43*f* side, the rotating shaft 43*f*, the pinion 44*f*, and the rack 38*f*, and the movable fence 33*r* on the car side is moved reciprocatingly in the longitudinal direction of the platform 30 by the driving motor 47*r* via the sprocket 48*r*, the chain 49*r*, the sprocket 45*r* on the rotating shaft 43*r* side, the rotating shaft 43*r*, the pinion 44*r*, and the rack 38*r*.

Next, the operation of the platform door device in accordance with the first embodiment, which is constructed as described above, will be explained.

The turning force of the drive motor 47*f* on the platform side is transmitted to the sprocket 45*f* on the rotating shaft 43*f* side via the sprocket 48*f* and the chain 49*f*. The rotating shaft 43*f*, which is supported on the bearings 41*f* and 42*f*, is rotated by the sprocket 45*f*, and the pinion 44*f* fixed on the rotating shaft 43*f* is rotated. By the rotation of the pinion 44*f*, the rack 38*f* engaging with the pinion 44*f* and the movable fence 33*f* installed to the rack 38*f* are moved in a reciprocating manner.

The movable fence 33*f* is moved in a reciprocating manner smoothly in the horizontal direction by sliding the beam 35*f*, which is fixed in the upper portion of the movable fence 33*f*, and the guide rail 36*f* on the slide block 34*f*, which is installed in the upper end portion of the support member 32*f*.

On the other hand, the turning force of the drive motor 47*r* on the car side is transmitted to the sprocket 45*r* on the rotating shaft 43*r* side via the sprocket 48*r* and the chain 49*r*. The rotating shaft 43*r*, which is supported on the bearings 41*r* and 42*r*, is rotated by the sprocket 45*r*, and the pinion 44*r* fixed on the rotating shaft 43*r* is rotated. By the rotation of the pinion 44*r*, the rack 38*r* engaging with the pinion 44*r* and the movable fence 33*r* installed to the rack 38*r* are moved reciprocatingly.

The movable fence 33*r* is moved in a reciprocating manner smoothly in the horizontal direction by sliding the beam 35*r*, which is fixed in the upper portion of the movable fence 33*r*, and the guide rail 36*r* on the slide block 34*r*, which is installed in the upper end portion of the support member 32*r*.

Therefore, if the drive motor 47*f* on the platform side and the drive motor 47*r* on the car side are rotated in the direction opposite to each other, the movable fence 33*f* on the platform side and the movable fence 33*r* on the car side are moved in a reciprocating manner in the direction opposite to each other by the above-described operation, by which a passage for passengers to getting on and off the car formed on the platform is opened and closed.

As described above, the first embodiment is configured so that the two support members 32*f* and 32*r* erected on the platform 30 are covered with the movable fences 33*f* and 33*r*, respectively, and the support member 32*f*, 32*r* is housed in the plane in the thickness direction of the movable fence 33*f*, 33*r*. Therefore, the width W1 (refer to FIG. 2) in the direction perpendicular to the side edge 30*a* of the platform 30 can be reduced significantly as compared with the configuration of the related art, in which two support members (support plates) and two movable fences are arranged parallel to each other in the direction perpendicular to the side edge of the platform, the two support members and the two movable fences are covered with a cover, and further the drive motor is disposed between the movable fence and the support member.

Thereupon, the platform door device of the first embodiment can avoid obstruction of the space along the side edge 30*a* of the platform 30 and hence hindrance to passing of passengers and other people, and also can provide some extra space to the platform 30. Also, as described above, the width W1 in the direction perpendicular to the side edge 30*a* of the platform 30 can be reduced significantly, so that the platform door device in accordance with this embodiment can easily be adopted even on the platform 30 with a narrow width.

Furthermore, according to the first embodiment, since the two support members 32*f* and 32*r* erected on the platform 30 are covered with the movable fences 33*f* and 33*r*, respectively, and the support member 32*f*, 32*r* is housed in the plane in the thickness direction of the movable fence 33*f*, 33*r*, a relatively moving portion between the support member 32*f*, 32*r* and the movable fence 33*f*, 33*r* is not exposed to the outside, and a covering function is provided to prevent dust etc. from entering into the relatively moving portion from the outside. Therefore, unlike the related art, a cover for covering the two support members and two movable fences need not be provided separately. Thereby, the number of parts can be reduced, and the construction can be simplified. Also, the thickness of platform door can be decreased accordingly.

According to the first embodiment, since the drive motors 47*f* and 47*r* for relatively moving the two movable fences 33*f* and 33*r* are housed in the driving system housing hole 50 provided in the platform 30, unlike the related art, the drive motor need not be arranged between the movable fence and the support member. This configuration can also significantly reduce the width W1 (refer to FIG. 2) in the direction perpendicular to the side edge 30*a* of the platform 30 as compared with the related art, so that the effective utilization of the platform 30 can further be improved.

Also, according to the first embodiment, the configuration is such that the pinion 44*f*, 44*r* and the rack 38*f*, 38*r* are driven by the driving force transmitting system in which the drive motor 47*f*, 47*r* is arranged under the pinion 44*f*, 44*r* which engages with the rack 38*f*, 38*r* provided in the lower end portion of the movable fence 33*f*, 33*r* to reciprocatingly move the movable fence 33*f*, 33*r* via the rack 38*f*, 38*r*, and the drive motor 47*f*, 47*r*, the sprocket 48*f*, 48*r*, 45*f*, 45*r*, and the chain 44*f*, 44*r* are arranged in the height direction. Therefore, the attachment width of the drive motor 47*f*, 47*r* and the driving force transmitting system does not increase in the direction perpendicular to the side edge 30*a* of the platform 30, and the drive motor 47*f*, 47*r* and the driving force transmitting system can be arranged in the plane in the thickness direction of the movable fence 33*f*, 33*r*. From this aspect as well, the effective utilization of the platform 30 can be improved.

Second Embodiment

Figure 5:
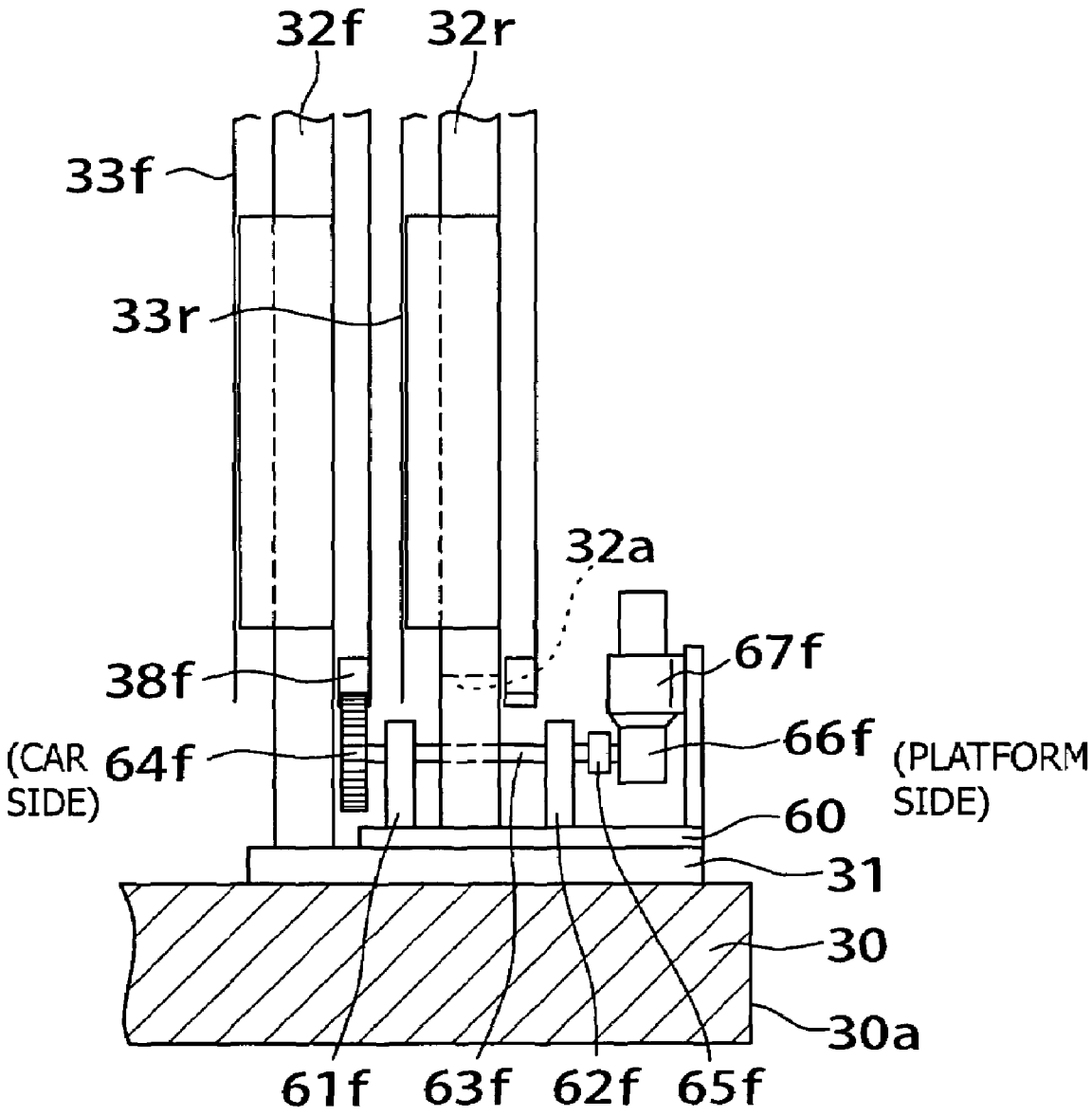
FIG. 5 is a side view of a principal portion of a platform door device in accordance with a second embodiment of the present invention.
Figure 6:
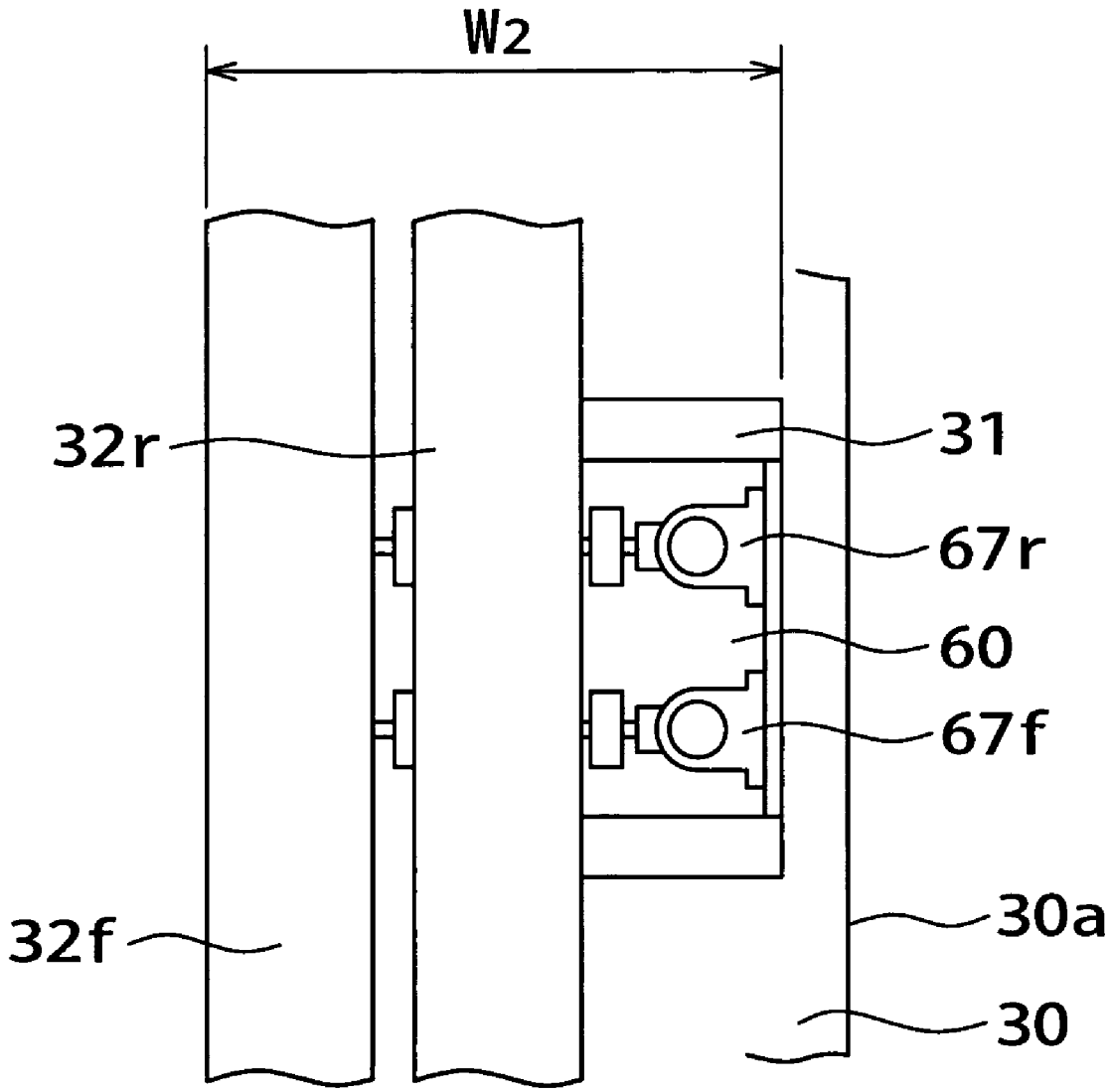
FIG. 6 is a plan view of a principal portion of a platform door device in accordance with the second embodiment.
Figure 7:
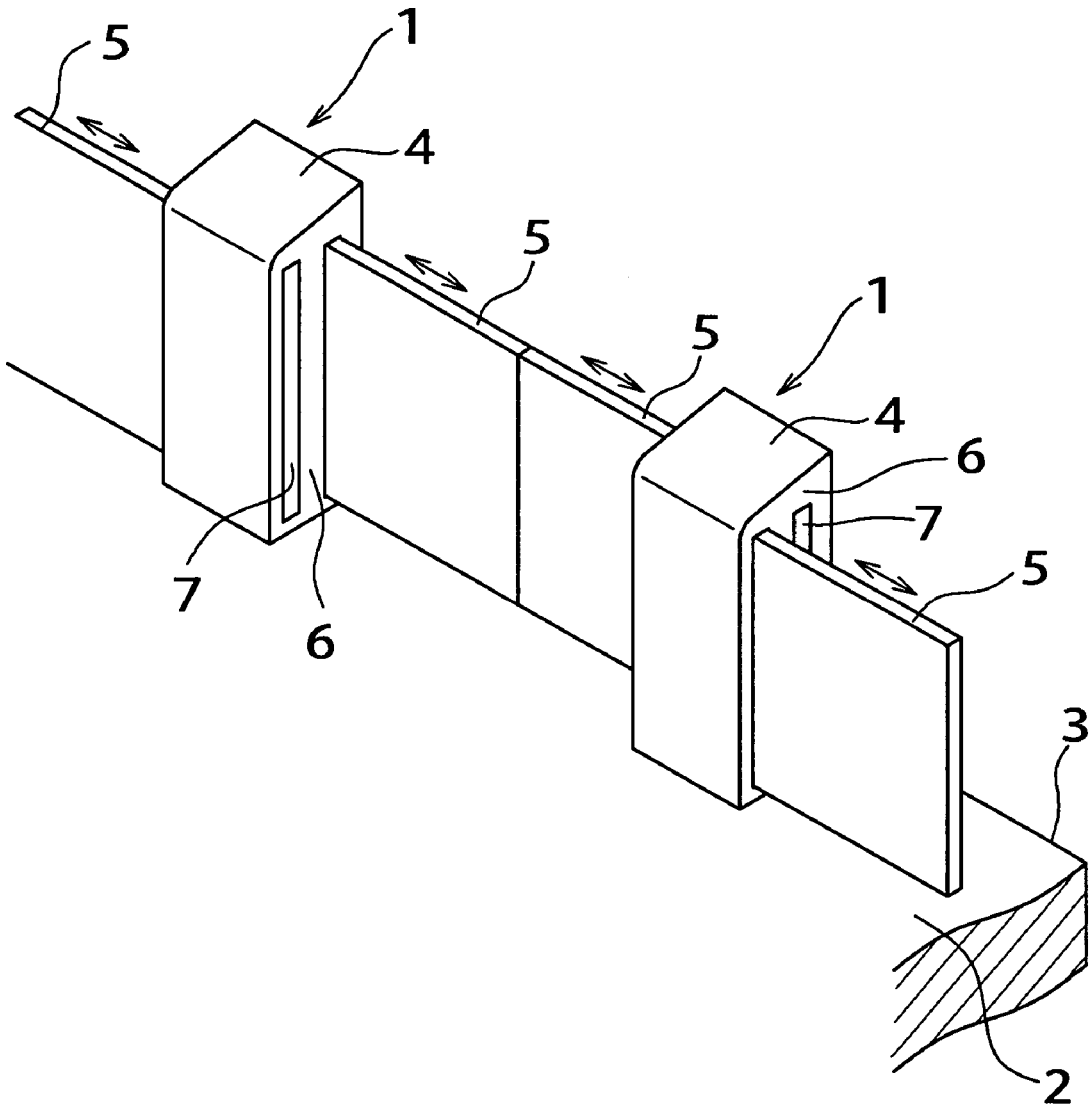
FIG.7 (RELATED ART)
FIG. 7 is a general perspective view of a platform door device in accordance with the related art.
Figure 8:
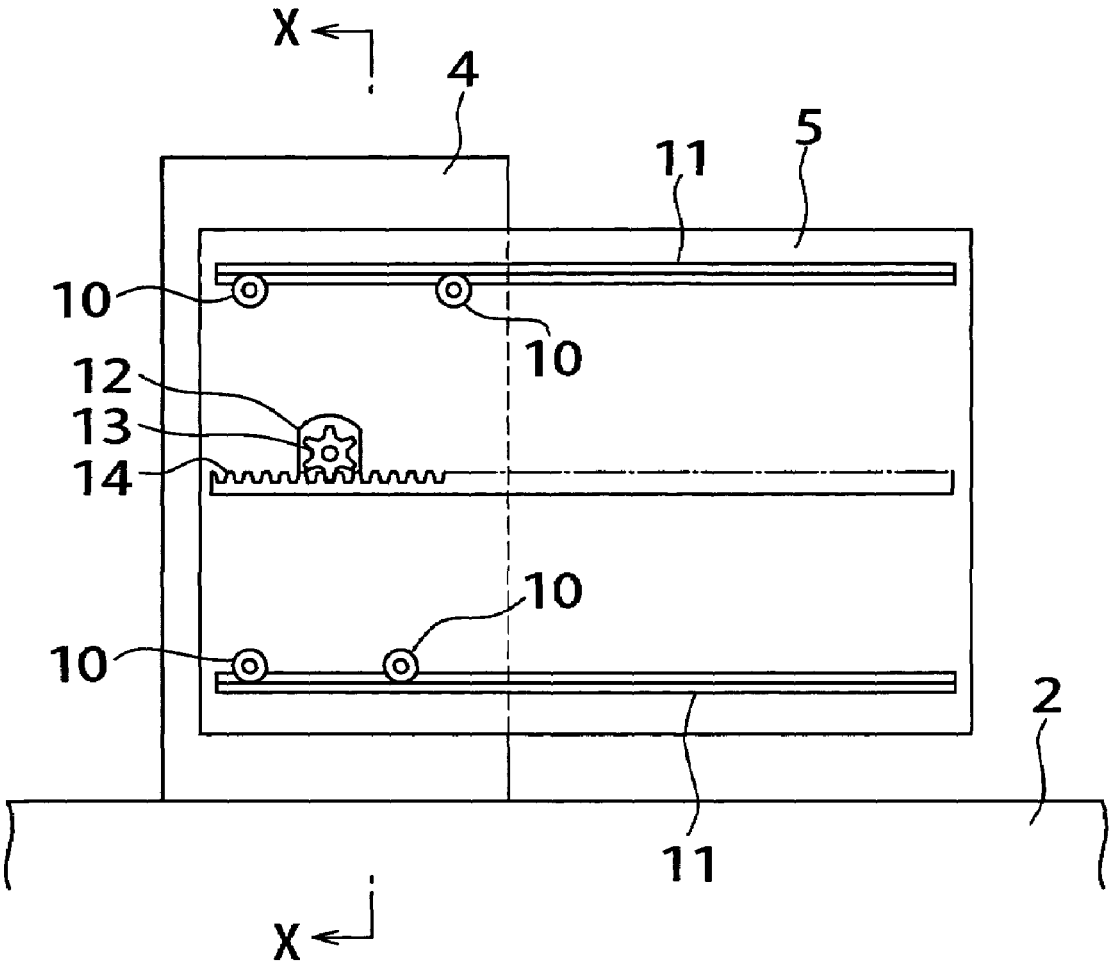
FIG.8 (RELATED ART)
FIG. 8 is a side view of a principal portion showing one side of a movable fence of a platform door device in accordance with the related art.
Figure 9:
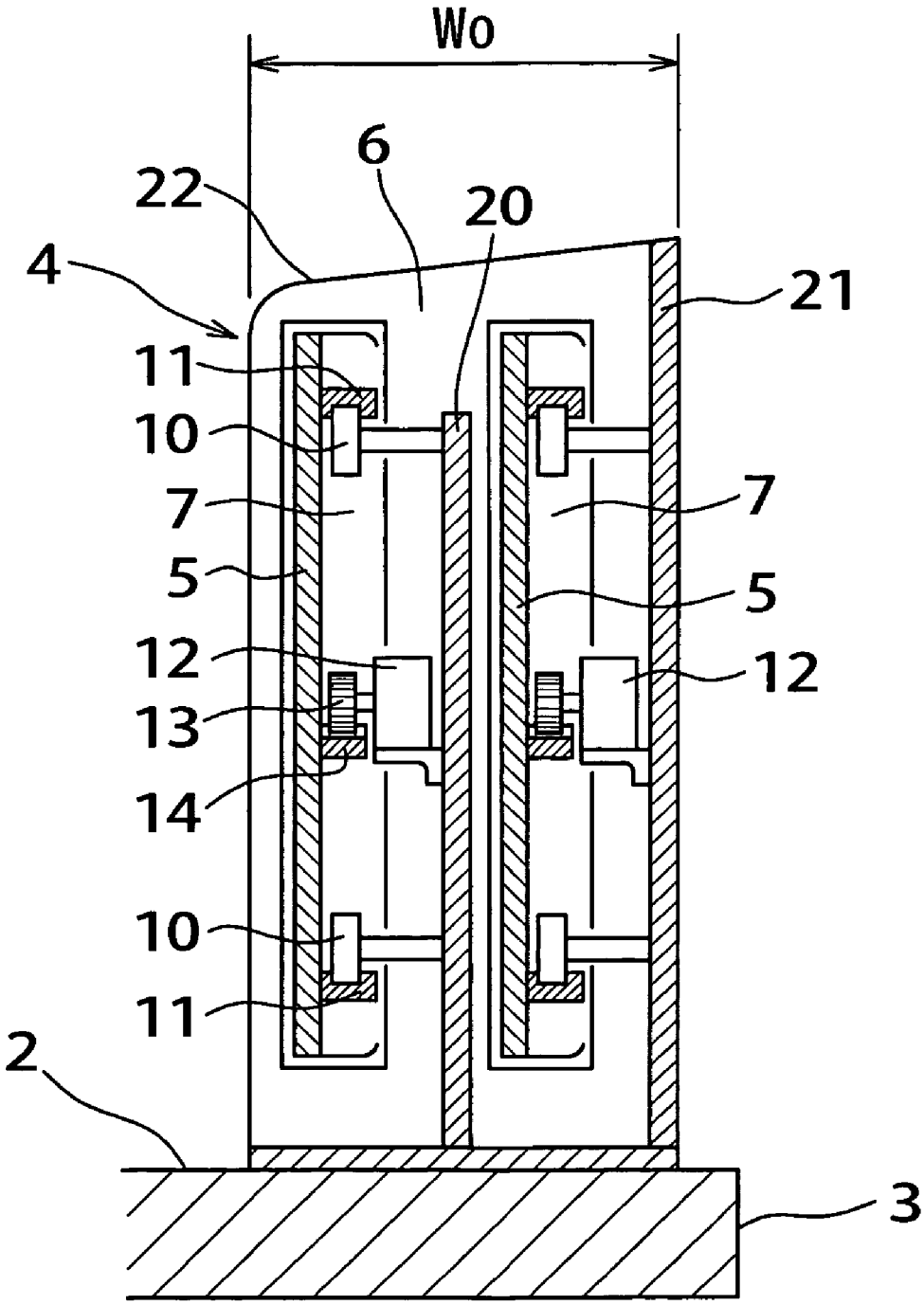
FIG.9 (RELATED ART)
FIG. 9 is a sectional view taken along the line X-X of FIG. 1.

FIG. 5 is a side view of a principal portion of a platform door device in accordance with a second embodiment of the present invention, and FIG. 6 is a plan view of a principal portion of the platform door device in accordance with the second embodiment.

In the second embodiment, drive motors 67*f* and 67*r* for driving the movable fences 33*f* and 33*r*, respectively, are disposed in one side position of either the movable fence 33*f* or 33*r*, preferably, on the side edge 30*a* side of the platform 30.

Specifically, in FIGS. 5 and 6, the drive motor 67*f* on the platform side and the drive motor 67*r* on the car side each having a miter gear 66*f*, 66*r* are installed to an attachment plate 60 fixed the bed plate 31.

The drive motor 67*f* on the platform side and the drive motor 67*r* on the car side are each connected to a rotating shaft 63*f*, 63*r* via the miter gear 66*f*, 66*r* and a coupling 65*f*, 65*r*. A pinion 64*f*, 64*r* is installed in the shaft end portion of the rotating shaft 63*f*, 63*r*, and the pinion 64*f*, 64*r* engages with the rack 38*f*, 38*r* provided in the lower end portion of the movable fence 33*f*, 33*r*. Reference characters 61*f* and 62*f* denote bearings for rotatably supporting the rotating shaft 63*f*, and reference characters 61*r* and 62*r* denote bearings for rotatably supporting the rotating shaft 63*r*.

Other configurations are the same as those in the first embodiment, and therefore the same reference characters are applied to the same elements as those in the first embodiment.

According to the second embodiment, even in a case where it is impossible to form the driving system housing hole 50 in the platform 30 as in the first embodiment, the drive motors 67*f* and 67*r* are disposed in one side position of either the movable fence 33*f* or 33*r* (preferably, on the side edge 30*a* side of the platform 30). Therefore, unlike the related art, the drive motor need not be arranged between the movable fence and the support member, so that the width W2 (refer to FIG. 6) in the direction perpendicular to the side edge 30*a* of the platform 30 can be reduced as compared with the related art, by which the effective utilization of the platform 30 can be improved.

Also, since the pinion 64*f*, 64*r* is attached directly to the rotating shaft 63*f*, 63*r* directly connected to the drive motor 67*f*, 67*r*, a special driving force transmitting system including sprockets and a chain as in the first embodiment is not needed, so that the construction is simple, and the number of parts can be reduced.

The above is a description of the embodiments of the present invention. The present invention is not limited to the above-described embodiments, and various changes and modifications can be made based on the technical concept of the present invention.

The invention claimed is:

1. A platform door device, comprising:

two support members; and two movable fences, which are provided along a side edge of a station platform, each of which is supported movably by a respective one of the support members, and which are adapted to move relative to each other in a longitudinal direction of the platform to open and close a passage between the platform and a car side, wherein the two support members are erected on the platform and are housed in the two movable fences, respectively;

each of the support members is arranged in a plane in the thickness direction of a respective one of the movable fences so as to be covered with the movable fence from the outside, whereby the movable fence is moveable relative to the support member, with the inner surface of the movable fence facing the outer surface of the support member;

the two support members, each being formed in the shape of a flat plate, are arranged in a direction perpendicular to the side edge of the platform, and are erected from and directly fixed, by welding, to a top surface of a bed plate installed on the platform;

a guide rail extending in the travel direction of the movable fences is provided on an upper inner surface of each of the two movable fences;

a slide block is installed in an upper end portion of each of the two support members; and the guide rail is slidable on the slide block, whereby the movable fence is moveable relative to the support member.

2. The platform door device according to claim 1, wherein a driving system for relatively moving the two movable fences is housed in a driving system housing hole formed in the platform, and an output end of the driving system is connected to a lower end portion of the movable fence via a driving force transmitting system.

3. The platform door device according to claim 2, wherein the driving force transmitting system is configured so that a rack, which is provided in the lower end portion of each of the two movable fences, and a pinion, which is rotatably supported on a rotating shaft and engages with the rack, are provided;

the driving system is disposed under the pinion; and the power of the driving system is transmitted to the pinion and the rack via a sprocket connected to the output end of the driving system and a chain, by which the two movable fences are moved relatively.

* * * * *